US005466900A

United States Patent [19]

Knapp

[11] Patent Number: 5,466,900

[45] Date of Patent: Nov. 14, 1995

[54] TAIL PIPE ADAPTER

[76] Inventor: William Knapp, 23950 S. Central Point Rd., Canby, Oreg. 97013

[21] Appl. No.: 205,650

[22] Filed: Mar. 4, 1994

[51] Int. Cl.[6] ..... F01N 7/08

[52] U.S. Cl. ..... 181/227; 285/62; 285/133.1

[58] Field of Search ..... 181/227, 228, 181/243; 285/62, 133.1, 138, 177

[56] References Cited

U.S. PATENT DOCUMENTS

| | | | |
|---|---|---|---|
| 3,457,724 | 7/1969 | Gandy et al. . | |
| 3,592,292 | 7/1971 | Lavallee | 181/227 |
| 4,537,280 | 8/1985 | Roberts | 181/243 |
| 4,638,632 | 1/1987 | Wulf et al. | 60/319 |
| 4,792,014 | 12/1988 | Shin-Seng | 181/280 |
| 4,906,032 | 3/1990 | Hohman | 285/177 X |
| 5,224,739 | 7/1993 | Sauter | 181/228 X |

*Primary Examiner*—Khanh Dang
*Attorney, Agent, or Firm*—James D. Givnan, Jr.

[57] ABSTRACT

The adaptor includes a tail pipe extension having a sleeve radially spaced about the extension to provide a circular space therebetween. Arms project outwardly from the extension and beyond the attached sleeve and constitute limit stops during installation of an inflatable cuff of an enging exhaust evacuation system. The sleeve serves to protect the cuff from extreme temperatures while ensuring proper attachment of the cuff and subsequent automatic separation from a vehicle.

6 Claims, 1 Drawing Sheet

TAIL PIPE ADAPTER

BACKGROUND OF THE INVENTION

The present invention pertains generally to automotive exhaust systems and apparatuses for collection and disposing of exhaust gasses.

In use today are exhaust evacuation systems installed in garages, automobile dealerships, fire stations and other locations where vehicles may be left with their engine running. Systems for evacuation of exhaust fumes from a building typically include a flexible conduit having an inlet end for placement on or near a vehicle tail pipe outlet. Such conduits can include a cuff at the conduit end which is inflatable to provide secure frictional attachment to the tail pipe end. Such a cuff is subjected to extreme temperatures and further, physical damage when incorrectly placed on the tail pipe end. Where inflated cuffs are used, a valve for cuff deflation is provided as well as automatic valve actuating means. The release of the cuff or disengagement of same from a tail pipe end can fail by the incorrect placement of the cuff about the tail pipe end, as for example, the cuff inserted beyond the end segment of the pipe. Additionally, partial installation of the cuff on the tail pipe can result, upon pressurizing of the cuff, in the cuff separating from the tail pipe.

U.S. Pat. No. 4,638,632 discloses an attachment for an exhaust stack or pipe for mixing ambient air with exhaust gasses. U.S. Pat. No. 3,592,292 shows an attachment for a tail pipe which admits ambient air into an exhaust flow. U.S. Pat. No. 4,537,280 shows a bell shaped coupling in an exhaust system. U.S. Pat. No. 4,792,014 shows an exhaust pipe attachment for inducing the flow of exhaust gasses. U.S. Pat. No. 3,457,724 shows a device with concentric conduits one each for exhaust gasses and an ambient airflow.

SUMMARY OF THE PRESENT INVENTION

The present invention is embodied within an adaptor for attachment to a tail pipe end to protect the cuff of an exhaust evacuator and to assure proper cuff placement on the tail pipe.

The present adaptor includes an extension for attachment to the end segment of a vehicle tail pipe. Disposed about the extension is a sleeve on which the evacuation conduit cuff is received. Limit stops at one end of the sleeve assure proper axial engagement of the cuff with the sleeve. Accordingly the cuff is isolated by the sleeve from direct contact with the tail pipe segment to prevent heat damage to the cuff with the limit stop means assuring proper cuff placement on the adaptor to assure proper manual or, more importantly, automatic separation of the cuff from the adaptor. Additionally provision is made for the entry of ambient air into the adaptor to reduce exhaust gas temperatures to enhance cuff life and the life of the exhaust conduit.

Important objectives of the present invention include the provision of an adaptor for securement to the end of a vehicle tail pipe to facilitate proper attachment of a cuff of an exhaust evacuation system conduit to avoid damage to the cuff as well as assure quick separation, either manually or automatic to enable rapid departure of an emergency vehicle; the provision of an adaptor including a tail pipe extension having a sleeve disposed thereabout with limit stop means serving to limit the axial engagement of an exhaust conduit cuff with the adaptor; the provision of an adaptor wherein ambient air may be drawn through the adaptor to protect the exhaust conduit sleeve from extreme temperatures.

DETAILED DESCRIPTION OF THE PREFERRED EMBODIMENTS

Figure 1:
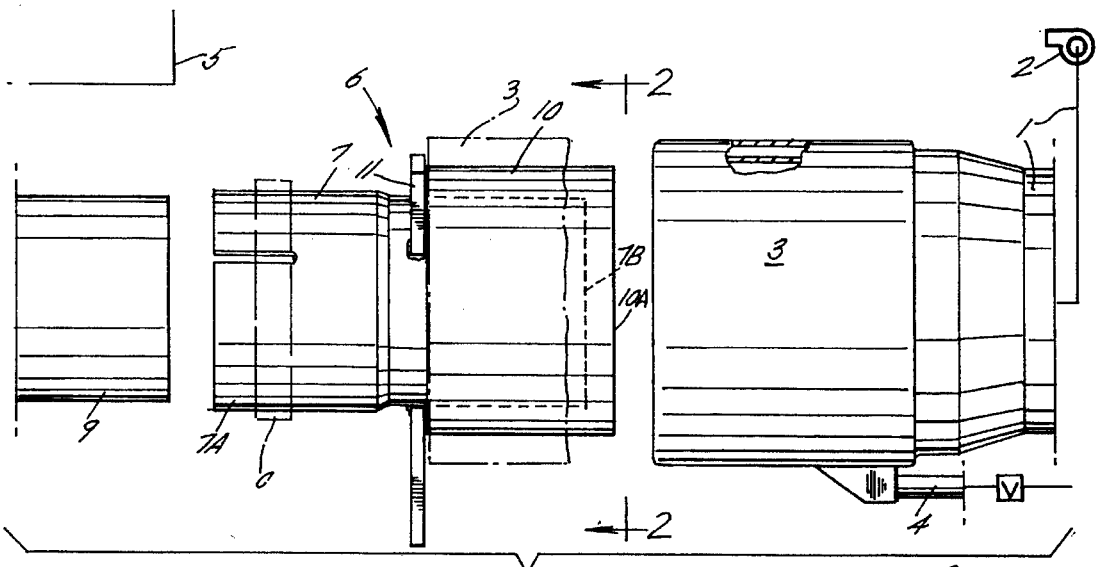
FIG. 1 is a side elevational view of the present adaptor with additional exhaust components separated therefrom.
Figure 2:
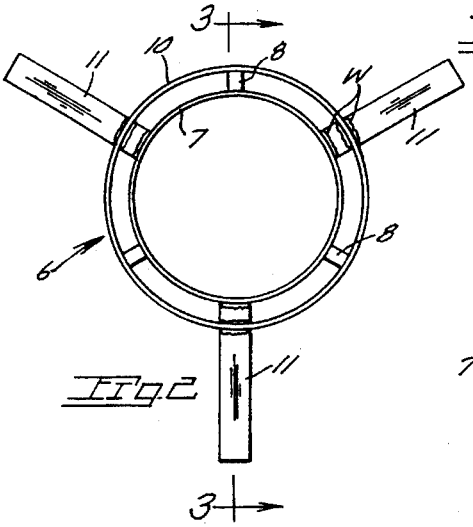
FIG. 2 is an end elevational view taken along line 2—2 of FIG. 1.
Figure 3:
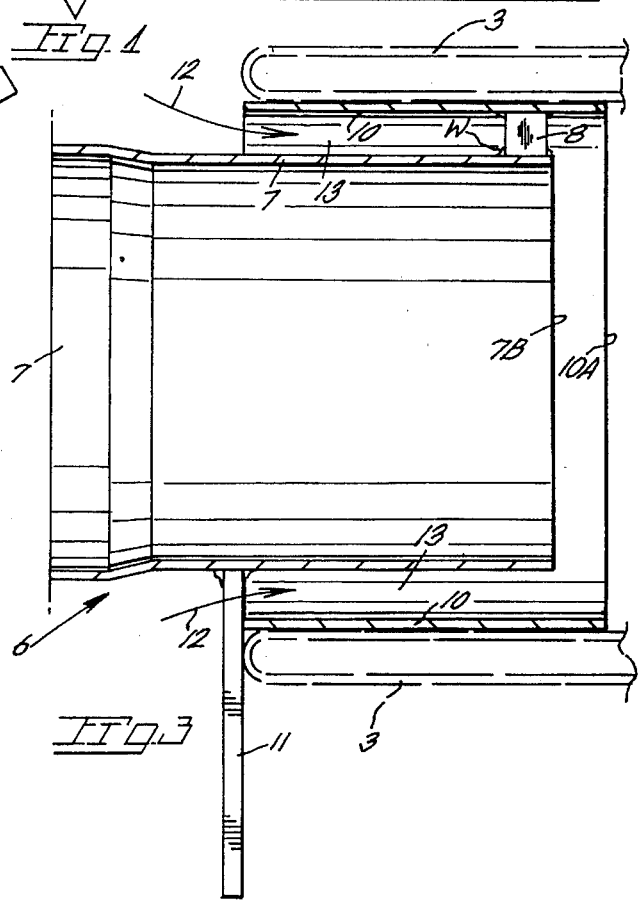
FIG. 3 is a vertical sectional view taken along line 3—3 of FIG. 2.

With continuing attention to the drawings, the reference numeral 1 indicates an exhaust conduit which is part of an exhaust evacuation system installed in building structure and including a reduced pressure source 2 in communication with said conduit. Indicated at 3 is a cuff carried by the conduit. For purposes of securing positive frictional engagement with the end of a tail pipe, the cuff is pneumatically inflatable via a compressed air line 4. On emergency vehicles such as fire trucks and ambulances, provision is made for cuff deflation by the actuation of a valve upon movement of the vehicle at 5 to permit the cuff to fall away from the tail pipe. Such separation can fail to occur if the cuff is improperly installed on the tail pipe as noted above.

With attention now to the present adaptor generally at 6, the same includes a generally cylindrical tail pipe extension at 7 which may be of non-uniform diameter such as in the case where one end is enlarged as at 7A for a snug fit with the tail pipe end segment at 9. A pipe clamp at C secures the extension in place. An outlet end 7B of the extension carries spacers as at 8 which support a sleeve 10 in radially spaced relationship to extension 7. Welds at W join the spacers and later described arms to the extension and sleeve.

Limit stop means 11, shown as radially extending arms, project outwardly beyond sleeve 10 and limit inward travel of inflatable cuff 3 during sleeve installation on adaptor sleeve 10. The circumference of sleeve 10 is of a diameter for snug frictional engagement with the cuff inner surface upon cuff inflation. Automatically actuated valve means (not shown) in communication with air line 4 controls inflation and deflation of the cuff. Movement of the vehicle resulting in actuation of the valve of the valve and automatic disconnection of the deflated cuff. Details of the exhaust evacuation system for a building are not essential to an understanding of the present invention.

With the present adaptor operatively disposed on the end segment of tail pipe 9, an airflow, represented by arrows 12, enters the annular space 13 between extension 7 and sleeve 10 for entry into an exhaust conduit 1. The airflow serves to diminish heating of sleeve 10 and cuff 3 thereon. Additionally outlet end 7B of extension 7 is disposed proximate the downstream end at 10A of sleeve 10 and shields the sleeve from impingement of engine exhaust gasses.

The present adaptor is suitable for use with an exhaust extraction system distributed by the PlymoVent Corp., of Edison, N.J.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An adapter for attachment to the end of an automotive engine tail pipe to facilitate the attachment of an exhaust conduit to said end, said adapter including:

a tail pipe extension for attachment to the tail pipe, a sleeve, means mounting said sleeve about said extension in radially spaced relationship with the extension, and limit stop means on said extension and projecting in a radial manner outwardly beyond the exterior of said sleeve to limit the travel of the conduit applied in an axial direction to the sleeve.

2. The adaptor claimed in claim 1 wherein said limit stop means includes an arm secured to said extension and to said sleeve spacing the latter from the extension.

3. The adaptor claimed in claim 1 wherein said limit stop means are radially extending arms.

4. The adaptor claimed in claim 1 wherein said extension and said sleeve define an annularly shaped passageway therebetween through which ambient air may flow into the exhaust conduit and retard heating of the sleeve by engine exhaust.

5. The adaptor claimed in claim 1 wherein said tail pipe extension and said sleeve have corresponding ends and are substantially coterminous at said ends to minimize exposure of the sleeve to engine exhaust gasses.

6. The adaptor claimed in claim 3 wherein said arms support an end of said sleeve, melds securing said sleeve to said arms.

* * * * *